United States Patent [19]

Platt et al.

[11] 3,982,737

[45] Sept. 28, 1976

[54] SPRING ASSEMBLY FOR UPHOLSTERED SEATS

[75] Inventors: John G. Platt; Harmon W. Arnold; Lloyd E. Tieman, all of Carthage; Robert O. Isaacs, Joplin, all of Mo.

[73] Assignee: Flex-O-Lators, Inc., Carthage, Mo.

[22] Filed: Apr. 9, 1975

[21] Appl. No.: 566,214

[52] U.S. Cl. ..... 267/102; 5/351; 5/260

[51] Int. Cl.[2] ..... F16F 3/00

[58] Field of Search ..... 267/103, 102, 107, 110; 5/351, 260, 247, 255; 297/456, 452; 5/456, 360

[56] References Cited

UNITED STATES PATENTS

| | | | |
|---|---|---|---|
| 2,313,020 | 3/1943 | Nussbaum | 267/102 |
| 2,384,191 | 9/1945 | Neely | 267/102 |
| 3,529,815 | 9/1970 | Garrison | 267/102 |

*Primary Examiner*—James B. Marbert
*Attorney, Agent, or Firm*—John A. Hamilton

[57] ABSTRACT

A spring assembly for a seat having a rigid frame including front and rear rails, comprising a flexible deck sheet connected at its rearward edge to said rear frame rail, with its forward edge spaced rearwardly from the front frame rail, a series of angled levers spaced across the forward edge of the deck sheet and vertically pivoted thereon, the longer upper legs of the levers being inclined upwardly to be spaced at their upper ends above the front frame rail to form a bolster support, links connecting the free ends of the shorter lower legs of the levers to the front frame rail, and springs applying elastic tension to the deck sheet, lower level legs and links between the front and rear frame rails.

17 Claims, 11 Drawing Figures

SPRING ASSEMBLY FOR UPHOLSTERED SEATS

Figure 1:
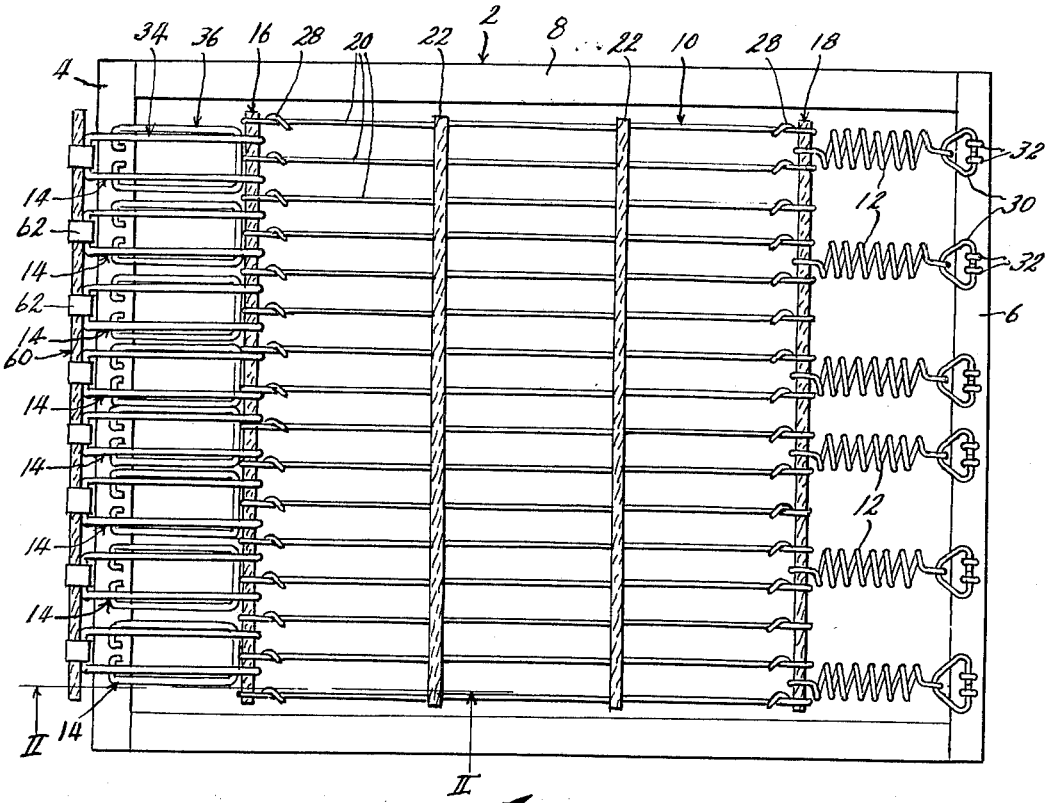

This invention relates to new and useful improvements in spring assemblies for upholstered seats, and has particular reference to that class of seating commonly known as "soft edge" seating.

Many attempts have been made to use wire fabric deck sheets, or other planar sheet material, resiliently supported by springs or other elastic members at their edges connected to the seat frame. Such wire fabric deck sheets have great advantages of simplicity, economy, and ease of installation. However, in such installations the padding material later applied over the deck is supported directly by the frame at the edges of the seat. This makes a "hard edge" seat, the edges having padding but no underlying spring support, the hard edge being particularly objectionable at the forward edge of the seat, which underlies the user's thighs near the knees, the hardness being uncomfortable, and also creating a "ridge" as the deck yields under the user's weight, which tends to inhibit circulation of blood in the user's legs.

To overcome this hard edge effect at the forward, and sometimes the side, edges of the seat, attempts have been made to form the deck sheet with an upwardly inclined forward edge portion angling upwardly in spaced relation above the front frame rail, with the deck sheet connections to the front frame rail being made at the rearward edge of the inclined portion of the sheet. The inclined portion forms a vertically resilient "bolster" support, which can yield downwardly to a substantial degree before it engages the solid support of the front frame rail. This gives a more comfortable soft edge effect. However, these attempts have been less than completely successful. The bolster portion of the sheet, since it extends forwardly beyond the connection of the sheet to the frame, was necessarily made resilient by means separate from the spring supporting the deck sheet in the frame. Ordinarily, resiliency of the bolster portion was provided by forming it of spring fabric, which could be an angled extension of the deck fabric if said deck itself were formed of spring fabric, while resilient support of the deck sheet was provided by edge springs. This resulted in the requirement that there be rather sharp bends in the spring wires of the bolster at its juncture with the deck sheet, to provide cantilever support for the bolster portion, with a resultant sharp flexure of said wires at said juncture every time the seat was loaded or unloaded. This extreme concentration of stress in the spring wires resulted in early failure and breakage of the wires.

Accordingly, a primary object of the present invention is the provision of a spring assembly providing a resiliently supported deck sheet from the forward edge of which a bolster support angles upwardly and forwardly and is resiliently deflectable downwardly, but which nevertheless involves no transverse flexure of spring wires in the bolster portion or at its juncture with the deck sheet, but utilizes a freely pivotal lever connection between the deck sheet and bolster portion. The bolster portion may be essentially rigid in and of itself, and the deck sheet may be essentially pliable, and a single set of springs or other elastically extensible members yieldable only in tension, supplies both vertically yieldable resilient support for the deck sheet, and resiliently yieldable cantilever support for the bolster portion.

Generally, this object is accomplished by the provision of a deck sheet having forward and rearward edge strands, the rearward edge strand being connected to the rear frame rail, a series of angled levers vertically pivoted at their angles on said forward edge strand at spaced points therealong, the longer upper legs of said levers extending upwardly and forwardly over the front frame rail to form the bolster portion of the assembly, vertically pivoted links connecting the shorter lower legs of said levers to said front frame rail, and springs or other resiliently extensible members constituting or forming elements either of the connection of said rearward deck strand to said rear frame rail, or of said links, whereby the assembly is tensioned from front to rear between said frame rails. Thus, downward loading of the deck sheet of course extends said springs and permits vertical yielding of the deck sheet, while downward deflection of the bolster portions of the levers pivots said levers on the forward edge strand, and hence also extends said springs. Neither the yielding of the deck nor of the bolster thus need involve any sharp transverse resilient flexing of any wire strands of the deck or bolster. However, the use of spring wire strands in the deck sheet, which are flexed, though to a smaller degree, has advantages which will later appear. The bolster levers may also have different forms and constructions, as will appear, but all have the same general operation.

Other objects are simplicity and economy of construction, and efficiency and dependability of operation.

Figure 2:
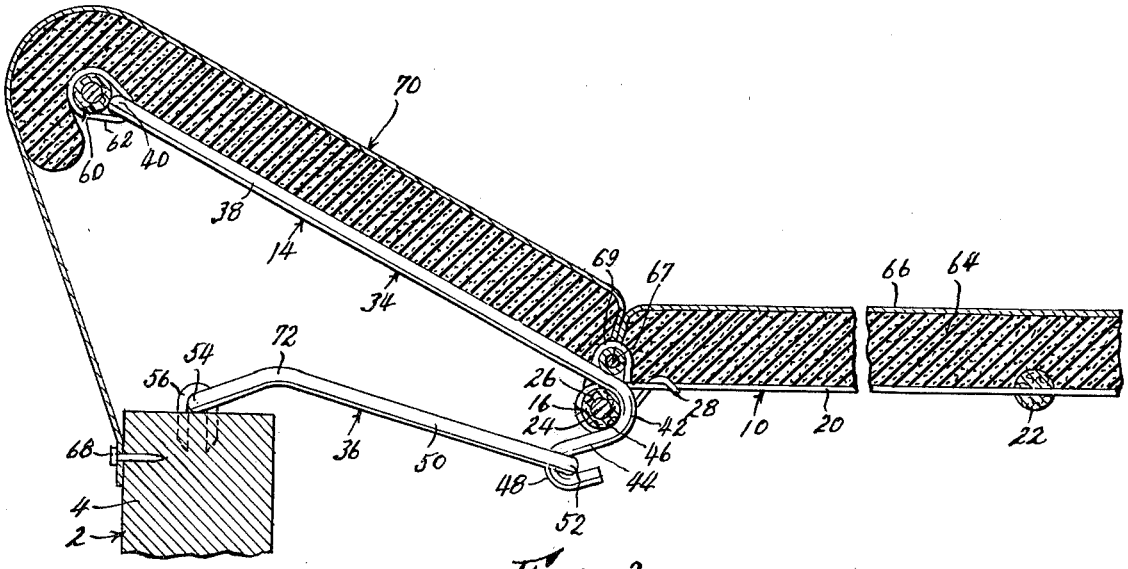
Figure 3:
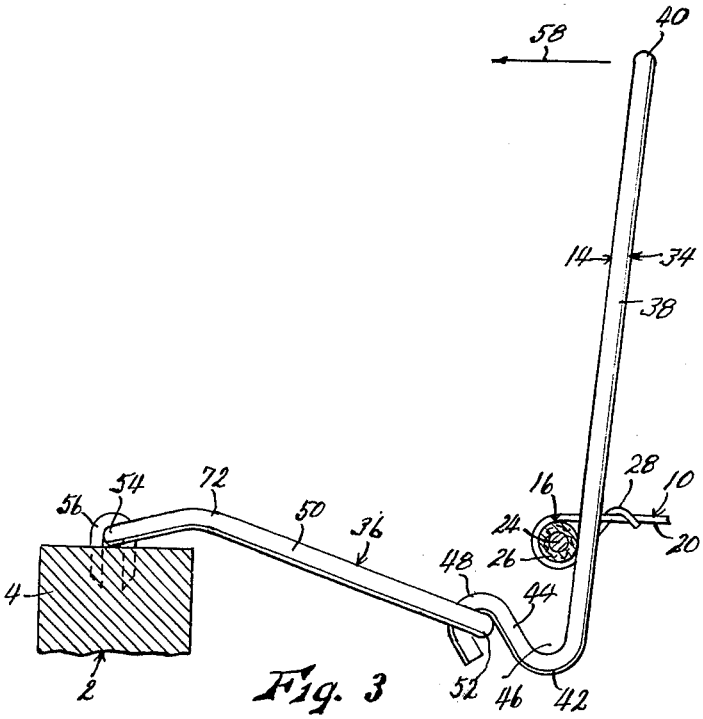
Figure 4:
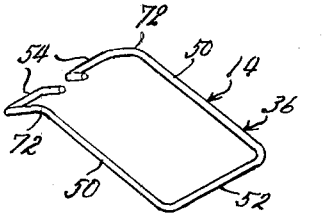
Figure 5:
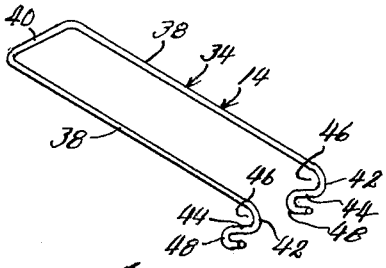
Figure 8:
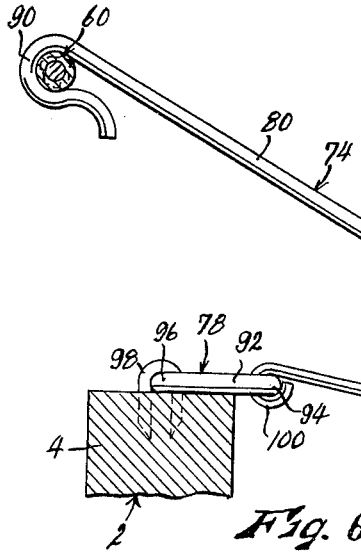
Figure 8:
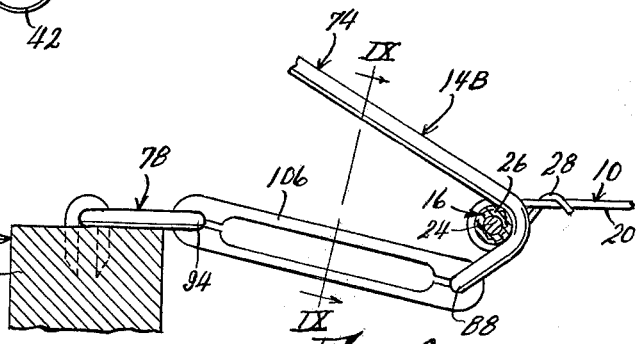
Figure 6:
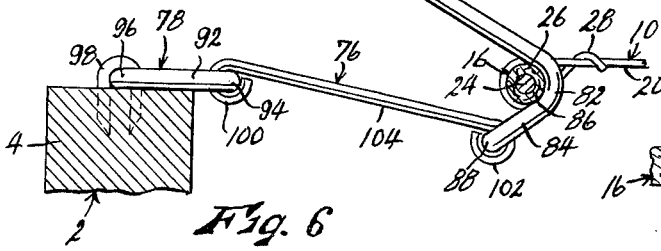
Figure 9:
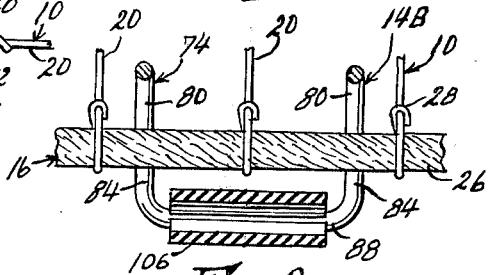
Figure 7:
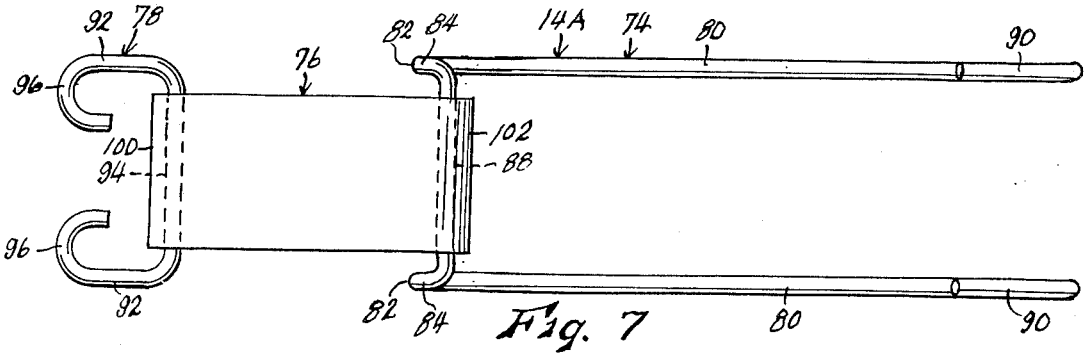
Figure 10:
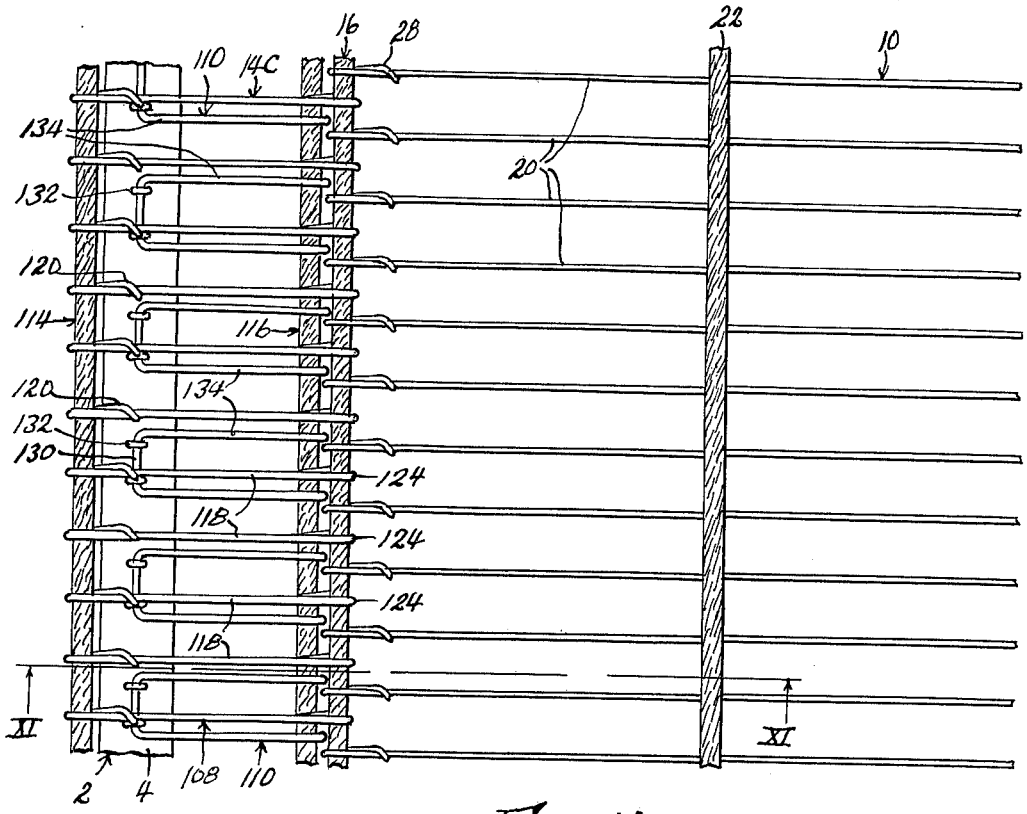
Figure 11:
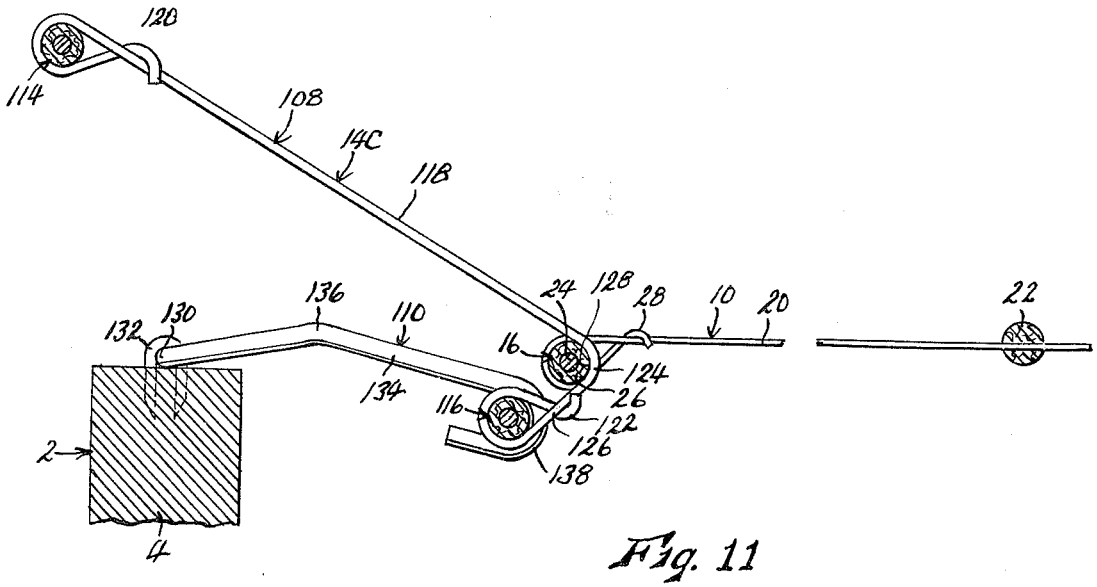

With these objects in view, as well as other objects which will appear in the course of the specification, reference will be had to the accompanying drawing, wherein:

FIG. 1 is a top plan view of a seat frame having a spring assembly embodying the present invention operatively mounted therein with the padding omitted, FIG. 2 is an enlarged, fragmentary sectional view taken on line II—II of FIG. 1, partially borken away and foreshortened, including the padding, FIG. 3 is a view similar to FIG. 2, showing the parts at an intermediate stage of the mounting thereof, FIG. 4 is a perspective view, to a reduced scale, of the link of the lever-link assembly shown in FIGS. 2 and 3, FIG. 5 is a perspective view, to a reduced scale, of the lever of the lever-link assembly shown in FIGS. 2 and 3, FIG. 6 is a view similar to FIG. 2, showing a lever-link assembly of a modified form, but with the padding omitted, FIG. 7 is a detached view of the lever-link assembly of FIG. 6, stretched out to lie substantially flat, FIG. 8 is a fragmentary view similar to FIG. 2, showing a lever-link assembly of a second modified form, FIG. 9 is a fragmentary sectional view taken on line IX—IX of FIG. 8, FIG. 10 is a fragmentary view similar to FIG. 1, showing a lever-link assembly of a third modified form, and FIG. 11 is an enlarged fragmentary sectional view taken on line XI—XI of FIG. 10, partially broken away and foreshortened.

Like reference numerals apply to similar parts throughout the several views, and the numeral 2 applies generally to a seat frame of generalized and simplified form, including generally parallel front and rear rails 4 and 6 and side rails 8, rigidly joined in a unitary structure. The spring assembly forming the subject matter of the present invention, as shown in FIGS. 1–5, comprises generally a rectangular deck sheet 10, springs 12 at the rearward edge of the deck sheet, and lever-link assemblies 14 at the forward edge of said deck sheet.

As shown, deck sheet 10 consists of a forward edge strand 16 and a rearward edge strand 18 parallel to said forward strand, a continuous series of spaced spring cross wires 20 extending between the front and rear strands and attached thereto, and one or more intermediate strands 22 extending parallel to the front and rear strands at regularly spaced intervals therebetween. The front and rear strands, as shown in FIGS. 2 and 3, each comprise a spring wire core 24, heavier in weight than cross wires 20, covered by a sheath 26 of twisted paper on other soft, indentable material. Cross wires 20 are each "knotted" about the forward and rearward edge strands by being twisted about said strand and then about itself, as indicated at 28, the paper sheath providing good purchase for the cross wires, and eliminating "wire noises". Intermediate strands 22 serve to maintain the spacing of the cross wires throughout their lengths, and may consist entirely of twisted paper without wire cores, being pierced by the cross wires.

Deck sheet 10 is disposed generally at the level of the top of frame 2, with its forward edge strand 16 and rearward edge strand 18 being spaced respectively rearwardly of front frame rail 4, and forwardly of rear frame rail 6. Springs 12 are of the ordinary helical type, and extend forwardly and rearwardly of frame 2 in spaced relation thereacross, each spring being hooked at its forward end about rearward edge strand 18 of the deck sheet, and hooked at its rearward end into a triangular wire hanger member 30 secured to rear frame rail 6 by staples 32.

Each lever-link assembly 14 consists of a lever member 34 and a link member 36, as best shown in FIGS. 2–5. The lever member 34 constitutes a length of heavy wire bent in substantial U-form as best shown in FIG. 5, including generally parallel legs 38 joined at their upper ends by connecting wire portion 40. At its lower end, each leg 38 is bent downwardly and forwardly, as at 42, to form a short downwardly and forwardly inclined leg 44 at an acute angle to leg 38, a bight 46 being defined between legs 38 and 44, and then rebent on itself to define a rearwardly opening hook 48. All of the bends of each leg 38 lie in parallel planes normal to the plane defined by legs 38. Each link member 36 also comprises a length of heavy wire but substantially in U-form, as best shown in FIG. 4, having a pair of generally parallel legs 50 joined by connecting wire portion 52, and bent inwardly at their opposite ends into coaxial end portions 54.

In mounting the assembly, deck sheet 10 is first connected to rear frame rail 6 by springs 12 and spring hangers 32 as shown, and links 36 are connected to front frame rail 4 by staples 56 driven into rail 4, and engaging end portions 54 of the link. The link extends rearwardly from rail 4, and is vertically pivotable in the staples. Ordinarily, one lever-link assembly 14 would be provided for each spring 12, in front to rear alignment, but as shown, any selected number of either could be used. The legs 38 of each lever 34 of each lever-link assembly 14 are then inserted downwardly between cross wires 20 of the deck sheet, adjacent forward strand 16 of said sheet, and their hooks 48 engaged about connecting portion 52 of the associated link 36, all as indicated in FIG. 3. The upper end of each lever 34 is then pressed forwardly, as indicated by arrow 58 in FIG. 3, pressing forward edge strand 16 of deck sheet 10 forwardly to tension springs 13, until strand 16 "snaps" into bights 46 of the lever, where it will be maintained by the tension of springs 12, so long as the angle between lever legs 38 and 44 is sufficiently acute. If the parts have been properly proportioned, this assembly procedure will apply a desired degree of pretensioning to deck sheet 10, in order to provide a seating surface of the desired degree of yieldability. It also utilizes the lever-link assemblies 14 as assembly tools, eliminating any necessity for the use of special tensioning tools usually required when mounting deck sheets of the type shown in seating frame under spring tension.

The upper ends of legs 38 of levers 34 are then connected to a single transversely extending margin strand 60 by means of clamp type clips 62 (see FIGS. 1 and 2). Strand 60 may be identical in all respects to forward and rearward edge strands 16 and 18 of the deck sheet. The clips encircle and join the margin strand to the top connecting portions 40 of the levers. Padding material 64 is then applied over the entire top surface of the frame, covering deck sheet 10, which forms the main seating surface, and the upper legs 38 of levers 34, which form the bolster, and the padding secured by a cover sheet 66 applied thereover, pulled down around the edge of the frame, and secured to said frame as by nails 68, all as well known in the art. It may also be secured to front strand 16 of the deck sheet by listing wire 67 and clips 69. It will be understood that as the padding is thus applied, the tension of the cover sheet at the front edge of the frame pulls margin strand 60 and lever legs 38 downwardly, thus pivoting the levers about front deck strand 16, causing said levers to react with links 36 to urge strand 16 forwardly, thus further extending springs 12. Thus springs 12 also serve to urge lever legs 38 resiliently upwardly. Margin strand 60 would be disposed substantially higher above front rail 4 than shown in FIG. 2, before the padding and cover sheet are applied. Assembly is then complete.

In operation, it will be seen that as deck sheet 10 is top loaded in use, it can yield resiliently downwardly as permitted by springs 12, and that said springs, since they also urge the longer legs 38 of levers 34 resiliently upwardly, provide a functionally separate resilient support for the front bolster of the seat, indicated generally at 70 in FIG. 2. The degree of support for the bolster, as compared to that provided for deck sheet 10, can be varied by altering the relative lengths of lever legs 38 and 44. It will be noted that the legs 50 of links 36 are angled upwardly intermediate their ends, as indicated at 72, in order to avoid interference thereof with frame rail 4. The wire of which levers 34 are formed is sufficiently heavy as to render said levers substantially rigid, so that substantially no flexure of the lever, particularly at bends 42 thereof, occurs when the bolster yields downwardly. No flexure is required, since the resilient support of the levers is furnished by springs 12, not by their own resilience. The levers, in themselves, yield by pivoting thereof, not flexure, and it will be noted further that any wire noises which might otherwise occur as a result of pivoting motion between the levers and strand 16 are eliminated by the paper sheath 26 of said strand. Thus the yielding of the bolster involves no sharp bending or flexure of spring wires at its juncture with the deck sheet, either wires of the bolster or of the deck. As previously discussed, stress concentrations resulting from sharp bends and extreme flexures of spring wires along this juncture line have heretofore been an extremely common cause of short life and early failure of spring assemblies of this general type.

The use of flexibly resilient front and rear strands in the deck sheet, and margin strand 60, together with the series of separate lever-link assemblies spaced across the width of the seat, permits different sectors of the seat width to yield unequally, according to the placement and distribution of the load applied thereto. On the other hand, the use of double-legged levers and links, as shown, with the legs spaced well apart, provides that each lever will be firmly stabilized against lateral tilting relative to the seat by loads applied to the upper edge of the bolster. Margin strand 60 is required to provide good edge support for the bolster padding. Support for the padding over legs 38 of levers 34 is not required if, as shown, legs 38 are sufficiently numerous and closely spaced to prevent the padding from working down between said lever legs. If said lever legs are more widely spaced, it may be required that a separate padding support, or "insulator", such as a sheet of wire fabric, not shown, be applied over said lever legs before the padding is applied.

In the modification of the invention shown in FIGS. 6 and 7, all parts are identical except the lever-link assembly, in this case generally indicated at 14A. Assembly 14A includes a lever 74, link 76, and link hanger 78. Link 74 is again formed of heavy wire and is of general U-shape, including parallel upper legs 80 rebent adjacent their lower ends, as at 82, to form shorter lower legs 84 defining a bight 86 between said upper and lower legs, and joined at their lower ends by a connecting portion 88. The upper end portion of each upper leg 80 is rebent downwardly on itself to form a partially open-mouthed hook 90 into which margin strand 60 may be snapped. Link hanger 78 is also formed of heavy wire and is of general U-shape, having parallel side legs 92, a connecting portion 94, and inwardly rebent end portions 96 adapted to be secured to front frame rail 4 by staples 98. The hanger need not be pivotal relative to rail 4. Link 76 is formed of a broad strip of sheet metal, with its end portions bent to form generally cylindrical bearings 100 and 102 engaged pivotally respectively about connecting portion 94 of hanger 78, and connecting portion 88 of lever 74. To prevent metallic noises at these pivotal connections, the link 76 is provided with a liner 104 of paper or the like bonded thereto.

The operation of the modification of FIGS. 6 and 7 is substantially identical to that of FIGS. 1–5, except of course that in assembly, lever legs 80 must be inserted upwardly rather than downwardly between cross wires 20 of deck sheet 10 adjacent forward strand 16 thereof, before margin strand 60 is attached, and after hangers 78 are stapled to the frame. However, an advantage of the species of FIGS. 6–7 is that the entire lever-link assembly 14A may be preassembled in a unitary structure prior to sale. This constitutes a merchandising advantage to the seller, and is simpler and more convenient for the buyer.

In the species of the invention shown in FIGS. 8 and 9, the lever-link assembly is indicated generally at 14B. Assembly 14B includes a lever 74 and link hanger 78, which may be identical in all respects to the lever and link hanger of FIGS. 6–7, and a link 106 constituting an elongated, broad loop of rubber or other elastically extensible material, looped at one end about connecting portion 94 of hanger 78, and at its opposite end about connecting portion 88 of lever 74. A helical tension spring, not shown, could be used in place of rubber link 106. When this lever-link assembly is used, it will be understood that springs 12 of FIG. 1 are dispensed with, and that rearward edge strand 18 of deck sheet 10 is stapled directly to rear frame rail 6, since resilient links 106 would then perform both of the functions of springs 12 in providing separate forms of resilient support for the deck sheet and the bolster. This form of the invention has advantages in simplicity and ease of installation, although its operation is closely similar to that of the species previously described. However, it will be seen that when deck sheet 10 in this species is loaded, its forward edge strand 16 will be pulled downwardly and rearwardly away from front rail 4. This tends to move the bolster rearwardly of rail 4, and to open a horizontal "gap" between said rail and the deck. This is generally considered to be objectionable, so that use of the other species described is preferable.

In the form of the invention shown in FIGS. 10 and 11, the structure is identical in all respects to that of FIGS. 1–5 except for the lever-link assembly, in this case designated 14C. Lever-link assembly 14C includes a lever assembly 108 and a series of links 110. Lever assembly 108 is similar in most respects to deck sheet 10, including a forward edge strand 114 and a rearward edge 116 similar in all respects to edge strands 16 and 18, and a series of spring cross wires 118 extending in parallel, spaced apart relation between strands 114 and 116 and "knotted" thereabout as indicated at 120 and 122 respectively. The spacing of wires 118 of the lever assembly may be equal to the spacing of wires 20 of the deck sheet, with wires 118 projecting between adjacent pairs of wires 20. The longer upper portions of wires 118 form the bolster support, and they are uniformly rebent adjacent their lower ends, as at 124, to form shorter lower legs 126 with bights 128 being defined at the angle of the legs for receiving forward strand 16 of the deck sheet. The wire fabric of which the deck sheet and lever assembly is formed is usually manufactured by automatic machinery. In this case, the lever assembly would preferably be made first and bends 124 formed therein, and deck sheet 10 then formed, wires 20 being introduced between successive pairs of wires 118 during the process. A series of links 110 are used, each being formed of heavy wire and generally of U-form, including a connecting portion 130 adapted to be secured for vertical pivotal movement to front frame rail 4 by staples 132, and a pair of generally parallel legs 134 angled upwardly intermediate their ends as indicated at 136, each of said legs being rebent at its free end to form a hook 138 adapted to be engaged about the rearward edge strand 116 of the lever assembly. The operation of this species of the invention is generally similar to that of the first two species described. The permanent pre-assembly of the lever assembly with the deck sheet creates an advantage of ease and convenience of installation. It will be noted that links 110 could also be included in the pre-assembly, simply by closing hooks 138 about strand 116. The lever assembly is sufficiently flexible, about axes extending from front to rear of the seat, that different lateral portions of the assembly can yield to different degrees. The larger number of cross wires 118 in the lever assembly, as compared to the smaller number of stiffer lever legs 38 which would ordinarily be used in FIG. 1, provides that wires 118 would in all events be sufficiently closely spaced to serve as a padding support, so that no intervening insulator would be required. In this case, wires 118 would, unless extremely heavy, be flexed somewhat as the bolster is deflected downwardly. Therefore, in order to prevent undue flexure and stress concentration in said wires at their connnection to the deck sheet, that is, in bends 124 thereof, which is a prime objective of the invention, it is desirable that wires 118 be of at least somewhat larger diameter than cross wires 20 of the deck sheet, as shown.

Finally, it will be seen that in most respects the operation of the spring assembly described, in any of its forms, would be substantially identical even if deck sheet 10 were simply a sheet of any pliable material, inelastic in its own plane, rather than including spring wires 20 as shown. However, the use of said spring wires, extending at right angles to frame rails 4 and 6, has the advantage that the resilient stiffness thereby imparted to the deck sheet tends to reduce front-to-rear "hammocking" of the deck sheet when it is loaded, keeping it more nearly planar and forcing a larger proportion of the vertical yield of the deck to be accomplished by extension of springs 12 (or rubber loops 106), rather than by hammocking. Such hammocking is not considered to be conducive to the best comfort by modern standards.

While we have shown and described certain specific forms of our invention, it will be readily apparent that many other minor changes of structure and operation could be made without departing from the spirit of the invention.

What we claim as new and desire to protect by Letters Patent is:

1. A spring assembly for a rigid seat frame having generally parallel front and rear rails, said spring assembly comprising:

a. a deck sheet of flexible material adapted to overlie said frame with its forward edge spaced rearwardly from the front rail of said frame, b. rearward attaching means operable to secure the rearward edge of said deck sheet to the rear rail of said frame, c. a series of vertically angled, substantially rigid levers spaced across the forward edge of said deck sheet, each being pivoted vertically, at its angle, to the forward edge of said deck sheet, and including an upwardly and forwardly inclined upper leg extending to a point spaced upwardly from said front frame rail, and a lower leg extending forwardly and downwardly from the pivot of said lever, said upper legs forming a bolster support portion of the assembly, said legs both being vertically inclined relative to the normal plane of said deck sheet, d. a link pivoted vertically to the free end of each of said lower lever legs, and extending forwardly therefrom, e. forward attaching means operable to connect the forward end of each of said links to said front frame rail for vertical pivotal movement relative thereto, whereby said forward attaching means, said links, said lower lever legs, said deck sheet and said rearward attaching means form a continuous connection between said front and rear frame rails, and f. resilient tensioning means yieldable forwardly and rearwardly of said frame and interposed in said continuous connection as above defined, whereby said deck sheet is resiliently tensioned in its own plane, and whereby said levers are tensioned to cause upward pivoting thereof, whereby the bolster support formed by said upper lever legs is resiliently supported against downward deflection.

2. A spring assembly as recited in claim 1 wherein said deck sheet is inelastic in its own plane, but has a degree of resilient resistance to flexure transversely of its plane, whereby to resist hammocking thereof when it is top-loaded.

3. A spring assembly as recited in claim 2 wherein said deck sheet includes a series of regularly spaced resilient spring steel wires extending forwardly and rearwardly thereof.

4. A spring assembly as recited in claim 1 wherein the upper ends of the upper legs of said levers are connected by a horizontal, transversely extending resilient strand, whereby to provide edge support for bolster padding applied over the tops of the upper legs of said levers, while still permitting unequal deflections of said levers at different lateral portions of said assembly.

5. A spring assembly as recited in claim 1 wherein said spring deck comprises generally parallel forward and rearward edge strands and a laterally spaced apart series of cross wires extending between and affixed to said forward and rearward edge strands, said angled levers being engaged pivotally at their angles on said forward edge strand intermediate said cross wires.

6. A spring assembly as recited in claim 5 wherein the forward edge strand of said deck sheet is provided with a sheath of soft, indentable material, whereby to dampen any noises occasioned by pivotal movement between said edge strand and said levers.

7. A spring assembly as recited in claim 5 wherein the rearward edge strand of said deck sheet is spaced forwardly of said rear frame rail, and wherein said resilient tensioning means comprises a series of forwardly and rearwardly extending elongated elastic members, each connected at its forward end to said rearward edge strand, and adapted to be connected at its rearward end to said rear frame rail.

8. A spring assembly as recited in claim 1 wherein said rearward attaching means comprises a series of forwardly and rearwardly extending, longitudinally extensible springs each connected at its forward end to said deck sheet and adapted to be connected at its rearward end to said rear frame rail, whereby said rearward attaching means also comprises said resilient tensioning means.

9. A spring assembly as recited in claim 1 wherein said link of each lever includes a forwardly and rearwardly extending, elastically extensible member, whereby said link serves also as said elastic tensioning means.

10. A spring assembly as recited in claim 9 wherein said elastically extensible portion of each link comprises an endless loop of elastic material looped at one end about the free end of the lower leg of the associated lever, and wherein said link additionally includes a hanger member about which the opposite end of said elastic loop is engaged, and which is adapted to be affixed to said front frame rail.

11. A spring assembly as recited in claim 1 wherein each of said levers comprises a length of heavy, substantially inflexible wire of U-form to present a pair of generally parallel upper legs forming said bolster support, and rebent adjacent one end to form said generally parallel lower legs with bights between said upper and lower legs which pivotally engage the forward edge of said deck sheet, said bights engaging said forward deck sheet edge at laterally spaced apart points whereby to prevent lateral tilting of said lever relative to the seat.

12. A spring assembly as recited in claim 1 wherein the angle between the upper and lower legs of said levers is acute, whereby the forward edge of said deck sheet is maintained in the bights of said levers by the tension of said resilient tensioning means.

13. A spring assembly as recited in claim 12 wherein each of said levers is engageable about said forward deck edge, with said resilient tensioning means unloaded, to engage the longer leg thereof with said forward deck edge in spaced relation from the angle of said lever, whereupon the lever may be pivoted forwardly both to tension said resilient tensioning means and to engage the forward deck edge in the angle of said lever.

14. A spring assembly as recited in claim 1 wherein said link member comprises a sheet metal link pivoted at its rearward end to the free end of the lower leg of said lever, and wherein said forward attaching means comprises a hanger member pivoted vertically to the forward end of said link, and adapted to be affixed to said front frame rail.

15. A spring assembly as recited in claim 14 wherein said hanger and said lever include transverse horizontally extending wires, the respective ends of said link being formed in cylindrical bearings pivotally encircling said wires, said bearing portions of said link being provided with liners of soft material to alleviate noises which would otherwise be occasioned by pivotal movement of said link relative to said hanger and lever.

16. A spring assembly as recited in claim 1 wherein said links form portions of a continuous strip extending transversely of said deck sheet at its forward edge, said strip consisting of a resilient, transversely extending top edge strand, a lower edge strand parallel to said top strand, and a series of cross wires extending between and affixed at their ends to said top and bottom strands, said cross wires all being angled adjacent said bottom edge strand to form bights engageable forwardly and pivotally around the forward edge of said deck sheet, the longer upper portions of said cross wires forming said bolster support and said top edge strand serving to provide edge support for bolster padding to be applied over said bolster support, and said bottom edge strand serving as a pivotal support for the rearward ends of said links.

17. A spring assembly as recited in claim 16 wherein said body sheet is also formed of front and rear edge strands and cross wires extending between and affixed at their ends to said front and rear strands, the cross wires of said lever extending between successive pairs of cross wires of said deck sheet, and said front edge strand of said deck sheet forming a pivotal support for the bights of the cross wires of said lever.

* * * * *